United States Patent [19]

Uyeda

[11] 4,112,715

[45] Sep. 12, 1978

[54] PADLOCK

[75] Inventor: Tim M. Uyeda, South San Gabriel, Calif.

[73] Assignee: Klaus W. Gartner, La Palma, Calif.

[21] Appl. No.: 767,301

[22] Filed: Feb. 10, 1977

Related U.S. Application Data

[63] Continuation of Ser. No. 617,514, Sep. 29, 1975, abandoned.

[51] Int. Cl.[2] ..... E05B 67/02; E05B 67/12

[52] U.S. Cl. ..... 70/38 A; 70/52

[58] Field of Search ..... 70/38 R, 38 A, 38 B, 70/38 C, 39, 52, 371

[56] References Cited

U.S. PATENT DOCUMENTS

| | | | |
|---|---|---|---|
| 206,327 | 7/1878 | Hillebrand | 70/39 |
| 3,422,643 | 1/1969 | Foote | 70/38 B |
| 3,626,729 | 12/1971 | Fane | 70/38 A |
| 3,855,826 | 12/1974 | Hori | 70/38 A |

FOREIGN PATENT DOCUMENTS

| | | | |
|---|---|---|---|
| 415,439 | 10/1946 | Italy | 70/39 |

*Primary Examiner*—Robert L. Wolfe

*Attorney, Agent, or Firm*—Poms, Smith, Lande & Glenny

[57] ABSTRACT

A padlock construction which is adaptable to selectable lock cylinder and key combinations includes a hollow padlock body for receiving a selected lock cylinder, a cylinder guard for removably retaining the lock cylinder within the padlock body, a removable shackle bar and a compatible locking pawl for mating interengagement with the lock cylinder and for removably retaining the shackle bar within the padlock body.

1 Claim, 14 Drawing Figures

PADLOCK

This is a continuation of application Ser. No. 617,514, filed Sept. 29, 1975.

SUMMARY OF THE INVENTION

This invention relates generally to the lock systems and, more specifically, to padlocks.

Padlocks of various types are, of course, well known to the industry. It is common practice for each manufacturer to provide padlocks which may be "key compatible" with the other locks of that manufacture. This compatiblity allows the use of the same master key throughout an institution, such as a hospital or hotel, as long as the locks are all restricted to one manufacturer. Should additional locks be required, they must be purchased from the same manufacturer.

Practically speaking, the dependence upon the manufacturer for a compatible padlock has required the lock service industry to stock a large inventory of padlocks in order to provide for the needs of their customers.

The need for an improved padlock which will enable the lock service industry to reduce inventories, while at the same time improving service to their customers, is recognized.

Therefore, it is the primary object of the present invention to disclose and provide an improved padlock construction which is adaptable to selectable lock cylinder and key combinations.

It is a further object of the present invention to disclose and provide a group of interrelated lock parts which, in concert with a special standaradized padlock body and shackle will allow the lock service industry of fabricate a lock/key compatible padlock for any desired manufacturers' system of locks.

It is a still further object of the present invention to disclose and provide a padlock having a removable shackle for enabling the padlock to be locked when the removable shackle is assembled to the body; and locking means for locking the shackle when the shackle is assembled to the body and in a closed position, retaining the shackle to the body when the shackle is in an opened position and for releasing the shackle from the body to facilitate assembly and disassembly of said padlock.

The various advantages and improvements of the present invention in improved padlocks, as well as a better understanding thereof, will be obtained by those skilled in the art from a consideration of the following detailed description of an exemplary embodiment of the present invention. References will be made to the appended sheets of drawings which will be described briefly before the detail description of the exemplary embodiment.

DETAILED DESCRIPTION OF AN EXEMPLARY EMBODIMENT

Figure 1:
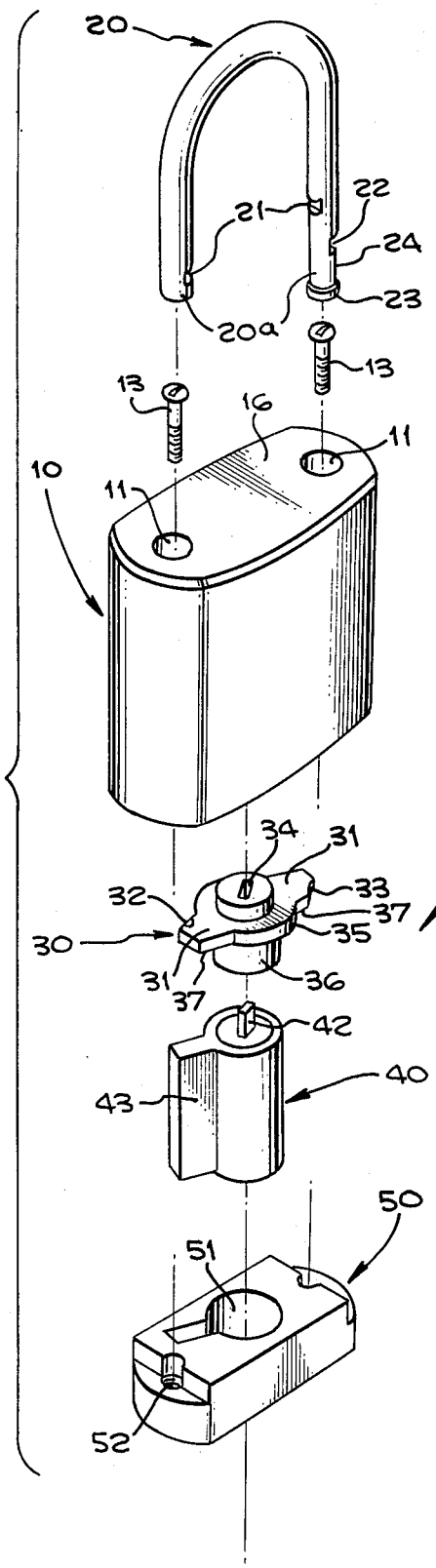
FIG. 1 is an exploded view of an exemplary embodiment of padlock according to the present invention showing exemplary shackle means, hollow case means, locking cam means, cylinder means, and cylinder guard means.

Referring first to FIG. 1, an exploded perspective view of an exemplary embodiment of a padlock construction adaptable to selectable lock cylinder and key combinations is shown. A padlock body 10 has a pair of shackle bar receiving apertures 11 in an otherwise closed end 16 of said body 10 which communicate with a cylinder receiving cavity (not shown) within said body 10 and, additionally, has an opening (not shown) through said body 10 to said cylinder receiving cavity which allows a selectable lock cylinder 40 to be introduced thereinto. Cylinder guard means 50 are fitable to padlock body 10 for closing the opening to the cylinder receiving cavity and for retaining lock cylinder 40 within said cylinder receiving cavity. Fastening means 13 are located within padlock body 10 and are operated through shackle bar receiving apertures 11 for retaining cylinder guard means 50 to said padlock body.

Locking means 30 within padlock body 10 removably retain a shackle bar 20 having a plurality of depending bar portions **20*a* insertable through the shackle bar receiving apertures 11 into the padlock body 10. Included in the locking means 30 are locking pawl means 31 having locking cam surface means 37 and pivotal mounting means 35 for mounting locking pawl means 31 in padlock body 10 for movement between positions of obstruction (FIG. 3) and non-obstruction (FIG. 7) of the shackle bar receiving apertures 11**.

Figure 2:
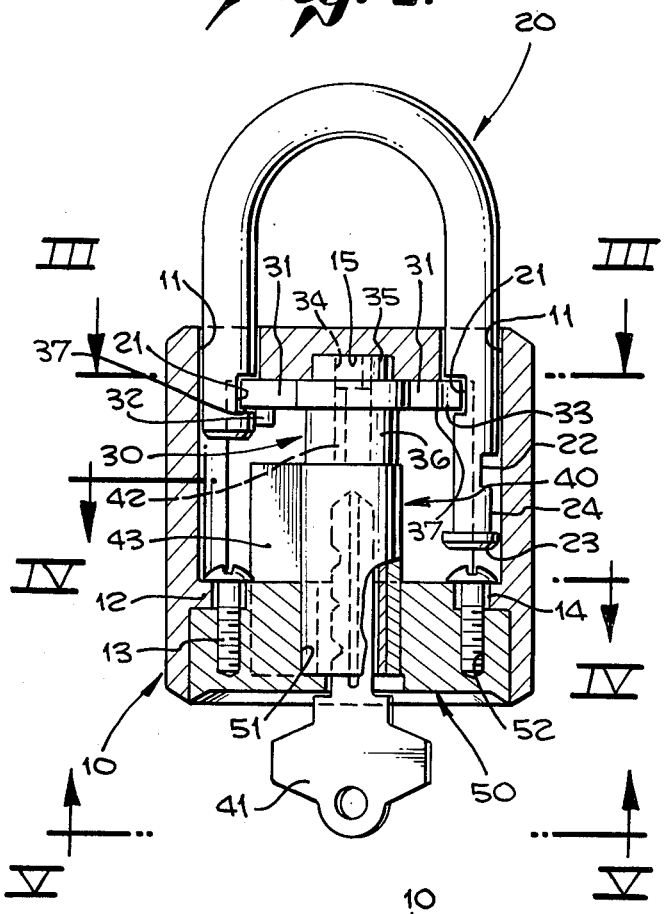
FIG. 2 is a side-sectional view of the padlock of FIG. 1 in the closed or locked position.

Shackle bar 20 has locking recesses 21 whereby the locking cam surfaces 37 of locking pawl 31, upon rotational interengagement with locking recesses 21, retains shackle bar 20 in a locked condition (FIG. 2).

Figure 3:
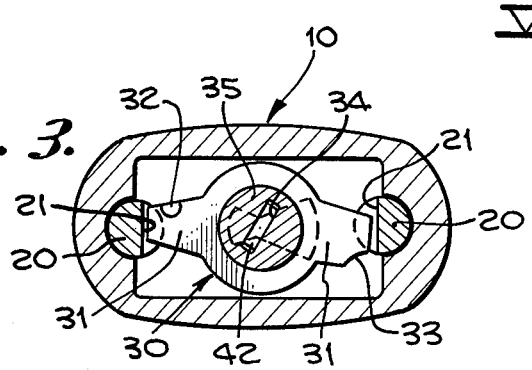
FIG. 3 is an end-sectional view taken through the plane III—III of FIG. 2.
Figure 4:
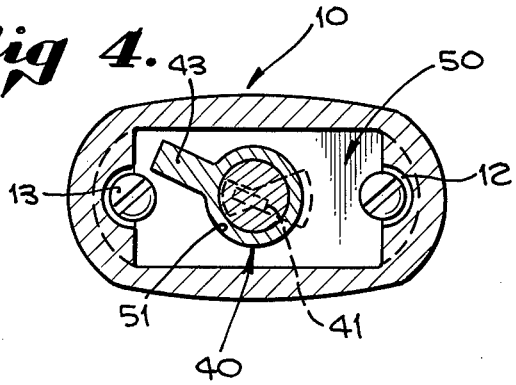
FIG. 4 is an end-sectional view taken through the plane IV—IV of FIG. 2.
Figure 7:
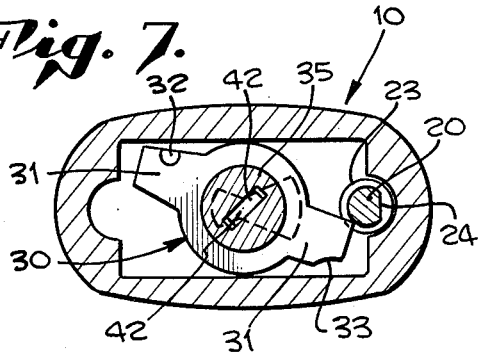
FIG. 7 is an end-sectional view taken through the plane VII—VII of FIG. 6.
Figure 8:
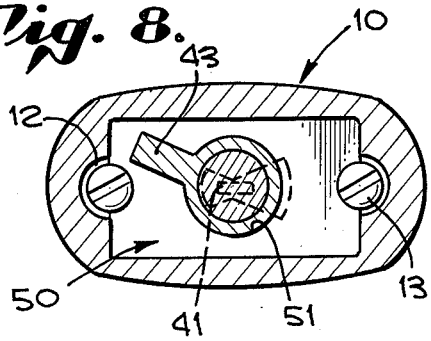
FIG. 8 is an end-sectional view taken through the plane VIII—VIII of FIG. 6.

Limiting means 32 on locking pawl 31 permit the locking cam surfaces 37 to rotate out of interengagement with locking recesses 21 of shackle bar 20 in only one direction (FIGS. 3 and 7). Should rotation be attempted in a contra-direction upon unlocking, limiting means 32 will contact shackle bar depending bar portion **20*a*** and prevent further rotation.

Figure 6:
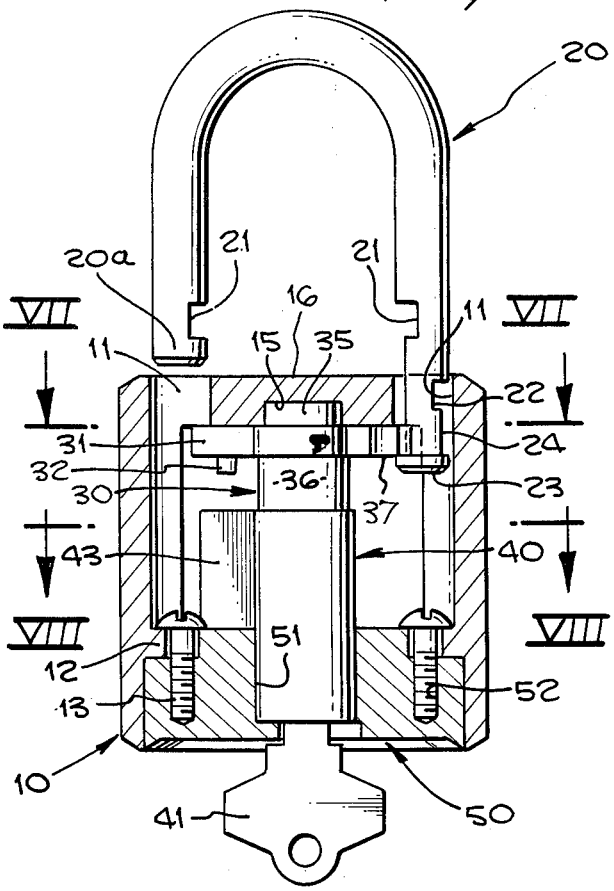
FIG. 6 is a side-sectional view of the padlock of FIGS. 1 and 2 in an opened or unlocked position.

Shackle stop flange 23 is attached to one of the depending bar portions 20*a* of shackle bar 20 for engagement with a portion of locking pawl 31 when the shackle bar 20 is in an unlocked position (FIGS. 6 and 7). This contact or engagement retains the depending bar portion of the shackle within the padlock body and prevents complete removal of the shackle bar from the padlock body during normal unlocking.

Figure 10:
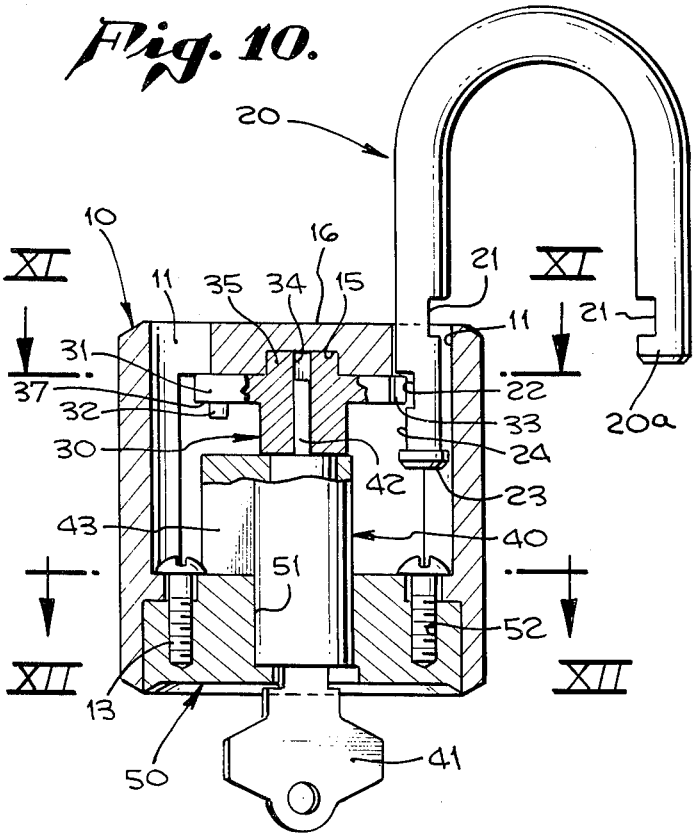
FIG. 10 is a side-sectional view showing the shackle position relative to the locking cam to allow rotation of the locking cam into the shackle removal position.
Figure 12:
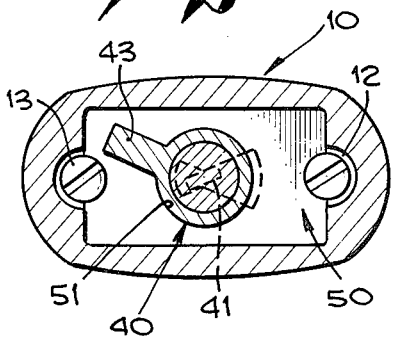
FIG. 12 is an end-sectional view taken through the plane XII—XII of FIG. 10.
Figure 13:
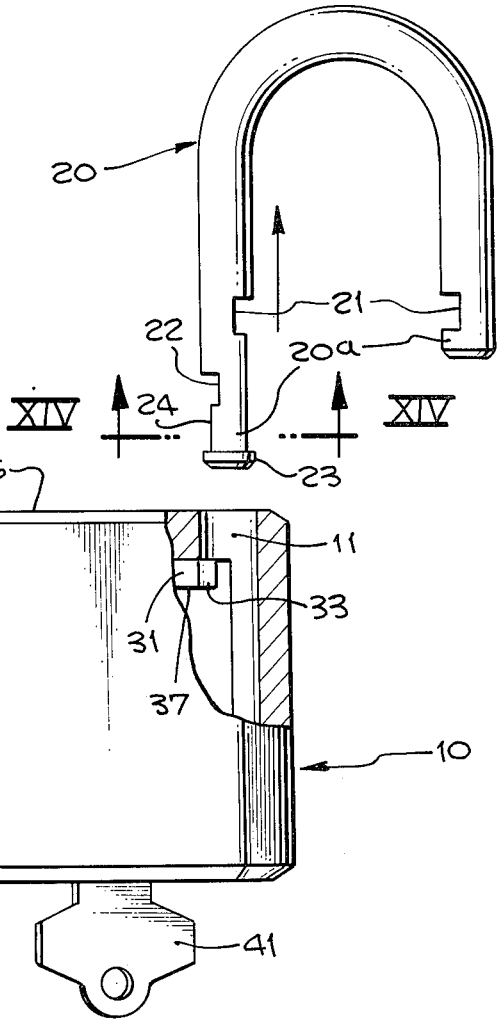
FIG. 13 is a partial side-sectional view showing the shackle removed from the case.
Figure 14:
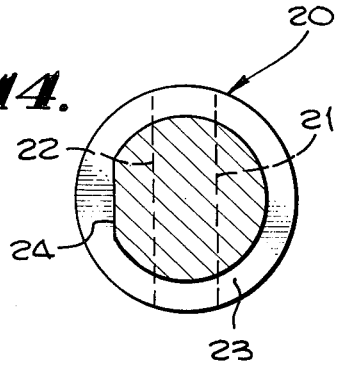
FIG. 14 is a sectional view of the shackle taken through the plane XIV—XIV of FIG. 13.
Figure 11:
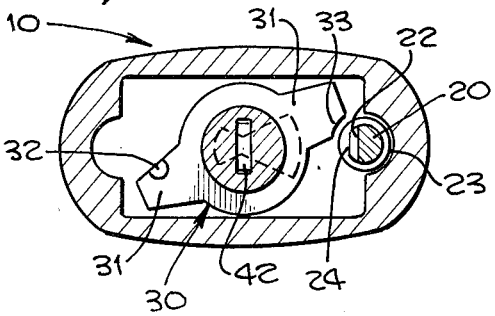
FIG. 11 is an end-sectional taken through the plane XI—XI of FIG. 10, showing the locking cam rotated to release the stop flange and to allow the shackle to be withdrawn from the case.

A shackle bar removal recess 22 is positioned within a portion of one of the depending bar portions 20*a* intermediate the shackle stop flange 23 and locking recess 21 (FIGS. 1 and 13). Upon depression of shackle bar 20 into a position intermediate fully locked and fully unlocked, and rotation in said intermediate position, the removal recess 22 may be aligned with locking pawl 31 thereby permitting counter-rotation of the locking pawl 31 from a normal unlocked position (FIGS. 10 and 11). It is apparent that, as the shackle bar is not fully depressed, limiting means 32 does not contact any shackle bar depending bar portion 20*a* and therefore does not interfer with said counter-rotation of said locking pawl 31.

A locking pawl notch 33 provides clearance between locking pawl 31 and shackle stop flange 23 subsequent to the depression, alignment and counter-rotation of the locking pawl. Once the locking pawl is counter-rotated from the normally unlocked position, the clearance between locking pawl notch 33 and shackle stop flange 23 will permit the complete withdraw of shackle bar 20 from padlock body 10 (FIGS. 11 and 13). Once shackle bar 20 is removed, access is provided through shackle bar receiving apertures 11 to the fastening means 13 within padlock body 10, thereby allowing removal of cylinder guard means 50 from padlock body 10.

Figure 5:
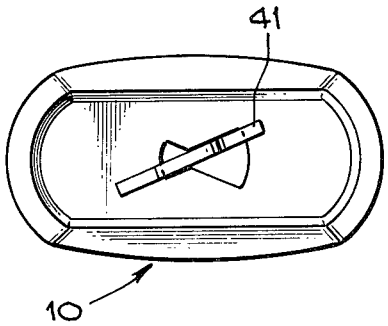
FIG. 5 is an end view taken through the plane V—V of FIG. 2.
Figure 9:
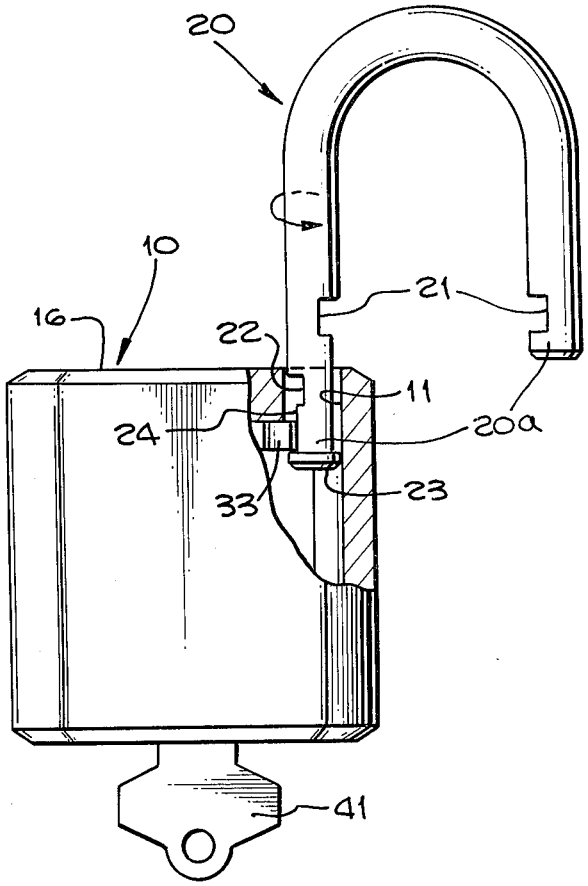
FIG. 9 is a partial side-sectional view of the exemplary padlock, showing the shackle rotated and the relation between the locking cam and stop flange which prevents inadvertent removal of the shackle from the case.

In an exemplary embodiment of a padlock construction, as shown in FIGS. 1, 2, 6 and 10, cylinder receptacle 51 of cylinder guard means 50 receives and positions any one of a plurality of selectable locking cylinders 40 within a separate hollow padlock body 10. Provision is made for receptacle 51 to conform exactly to the cross-sectional shape of cylinder 40, including any protrusions such as tumbler housing 43. As is readily apparent, this will eliminate any tendency for cylinder 40 to rotate within body 10 during operation of key 41. Key receiving means (not shown) of said lock cylinders are accessible through key receiving aperture 53 (FIG. 5) to allow insertion of a mating key 41 into selected cylinder 40 when assembled by cylinder guard means 50 to hollow padlock body 10.

Fastening means 13 are provided to fasten cylinder guard 50 to hollow padlock body 10 (FIGS. 1, 2, 6 and 10). In the exemplary embodiment, fastening means 13 may be machined screws which are extended through apertures 14 in internal flanges 12 of hollow padlock body 10 and are then screwed into internally threaded apertures 52 of cylinder guard 50, thereby drawing cylinder guard 50 firmly into contact with internal flange 12 upon tightening said fastening means 13.

Compatible locking means 30 selectable for mating interengagement with the selectable lock cylinder 40 of the padlock releasably lock a shackle bar 20 which is associated with the padlock construction (FIGS. 1, 2 and 10). In the exemplary embodiment, the mating interengagement is accomplished by the provision of cylinder pilot aperture 34 in locking means 30 which receives cylinder pilot 42.

As can be readily seen from the foregoing description of an exemplary embodiment of a padlock construction, the provision of a group of interrelated lock parts such as cylinder guard means, cylinder guard fastening means, and locking means will allow the use of any one of a plurality of selected lock cylinders in a single lock body. This flexibility in choosing a desired lock cylinder and key combination will facilitate matching a padlock with an already existing lock/key system, such as in a hospital or hotel.

The padlock shown in FIG. 1 has a body means 10 for receiving shackle means 20 which is lockable by an internal lock cylinder 40. In the exemplary embodiment, shackle means 20, which enables the padlock to be locked when said shackle 20 is assembled to said body 10, is removable.

Locking means 30 is provided for locking shackle 20 when assembled to body 10 and in a closed position (FIGS. 2 and 3). Locking means 30 retains shackle 20 to body 10 when shackle 20 is in an opened position (FIGS. 6 and 7). Further, locking means is capable of releasing shackle 20 from body 10 in order to facilitate assembly and disassembly of shackle 20 relative to body 10.

As shown in FIGS. 2, 3, 6 and 7 and 10, body 10 is hollow for accepting and enclosing any one of a plurality of standard lock cylinders 40. Cylinder guard means 50 retain said one lock cylinder 40 in the hollow body 10, and means 13 are provided for fastening cylinder guard 50 to hollow body 10, thereby securely retaining lock cylinder 40 within hollow body 10.

Positioning means 15 are provided for rotatably retaining locking means 30 in a constantly axially aligned position within hollow body 10. In an exemplary embodiment, as shown in FIGS. 2, 6 and 10, a recess within an interior surface of closed end 16 of body 10 positions an alignment pilot 35 of locking means 30.

Cylinder guard means 50 is provided with cylinder receptacle means 51 for fixedly securing and axially aligning the lock cylinder 40 within hollow body 10, thereby preventing displacement and rotation of the lock cylinder 40 during operation of the padlock (FIGS. 1, 2, 4, 6, 8, 10 and 12).

Removable shackle 20 is provided with stop flange 23 which contacts locking means 30 when shackle 20 is unlocked and withdrawn (FIGS. 6 and 7) whereby a portion of shackle 20 is retained within hollow body 10.

Removable shackle 20 is further provided with a removable recess 22 to allow locking means 30 to be moved into a release position (FIGS. 10 and 11) thereby allowing complete removal of shackle 20 from hollow body 10.

Locking means 30 are provided with limiting means 32 for restricting locking means 30 to rotation in only one direction when shackle 20 is in the locked position. Once the padlock is unlocked, limiting means 32 will allow rotation in either direction. In an exemplary embodiment, as shown in FIG. 3, limiting means 32 will contact shackle 20 while shackle 20 is locked if locking means 30 is rotated counter-clockwise. This contact will prohibit such rotation while the shackle is locked. Once the shackle is unlocked and withdrawn locking means 30 may be rotated counter-clockwise, as there is no possibility of contact between limiting means 32 and shackle bar 20 (FIGS. 7 and 11).

Locking means 30 are further provided with locking pawl notch means 33 which provides clearance between locking pawl 31 and shackle stop flange 23 once said locking pawl is rotated as shown in FIG. 11, thereby permitting withdrawal of shackle 20 from hollow body 10.

In an exemplary embodiment, as shown in FIGS. 10, 11 and 13, shackle 20 is depressed to a position intermediate fully locked and fully unlocked. It is then rotated 180° to the fully open position shown in FIG. 10, thereby aligning locking pawl 31 with shackle removal recess 22 such that locking means 30 may be fully rotated counter-clockwise as shown in FIG. 11. Once fully rotated, the locking pawl notch 33 will permit shackle stop flange 23 to clear locking pawl 31 and shackle 20 may be withdrawn from hollow body 10 as shown in FIG. 13.

It is understood that the foregoing detailed description is merely exemplary of the invention disclosed herein, the only intended limitations being contained within the appended claims.

I claim:

1. In a padlock having a body, shackle means having first and second portions, means for receiving said portions of said shackle means within said body and internal locking means for locking with said portions and operable by an associated key in a given direction to open the padlock, said shackle means having a first, fully locked position in which said first and second portions thereof are received in said receiving means, and a second fully unlocked position in which said second portion is outside said body, the improvement comprising the provision of:

means for removeably retaining said first portion of said shackle means to said body when said shackle means portions are unlocked by said internal locking means, said retaining means and said first shackle portion comprising cooperating means for fully releasing said first portion for complete removal of said shackle means from said body upon positioning said shackle means first portion in a position in said body intermediate said fully locked and fully unlocked positions and upon rotating said shackle means about the axis of said first portion to a predetermined position in which said second portion is non-aligned with said receiving means therefor and upon turning said associated key in said locking means in a reverse direction to said given direction.

* * * * *